US006857484B1

(12) United States Patent
Helms et al.

(10) Patent No.: US 6,857,484 B1
(45) Date of Patent: Feb. 22, 2005

(54) STEERING TOOL POWER GENERATING SYSTEM AND METHOD

(75) Inventors: Martin Helms, Burgdorf (DE); Satish K. Soni, Celle (DE)

(73) Assignee: Noble Drilling Services Inc., Sugar Land, TX (US)

( * ) Notice: Subject to any disclaimer, the term of this patent is extended or adjusted under 35 U.S.C. 154(b) by 120 days.

(21) Appl. No.: 10/367,526

(22) Filed: Feb. 14, 2003

(51) Int. Cl.[7] ..... E21B 7/00; E21B 7/04
(52) U.S. Cl. ..... 175/57; 175/61; 175/73
(58) Field of Search ..... 175/57, 61, 73

(56) References Cited

U.S. PATENT DOCUMENTS

| | | | | |
|---|---|---|---|---|
| 3,705,603 A | * | 12/1972 | Hawk | 137/624.14 |
| 3,738,436 A | | 6/1973 | Litchfield et al. | 175/65 |
| 4,394,881 A | | 7/1983 | Shirley | 175/76 |
| 4,407,374 A | | 10/1983 | Wallussek et al. | 175/24 |
| 4,596,293 A | | 6/1986 | Wallussek et al. | 175/27 |
| 4,781,229 A | | 11/1988 | Wilson | 144/213 |
| 4,854,794 A | | 8/1989 | Oertel | 411/307 |
| 4,947,944 A | | 8/1990 | Coltman et al. | 175/73 |
| 5,220,963 A | | 6/1993 | Patton | 175/24 |
| 5,232,058 A | | 8/1993 | Morin et al. | 175/76 |
| 5,603,386 A | | 2/1997 | Webster | 175/76 |
| 5,617,926 A | * | 4/1997 | Eddison et al. | 175/61 |
| 6,050,350 A | | 4/2000 | Morris et al. | 175/45 |
| 6,109,372 A | * | 8/2000 | Dorel et al. | 175/61 |
| 6,148,933 A | | 11/2000 | Hay et al. | 175/73 |
| 6,158,529 A | * | 12/2000 | Dorel | 175/61 |
| 6,244,361 B1 | * | 6/2001 | Comeau et al. | 175/61 |
| 6,290,003 B1 | | 9/2001 | Russell | 175/73 |
| 6,513,223 B1 | | 2/2003 | Angman et al. | 29/447 |
| 6,578,876 B2 | | 6/2003 | Guertin, Jr. | 285/148.2 |
| 6,652,181 B1 | | 11/2003 | Geiger | 403/297 |
| 2003/0075924 A1 | | 4/2003 | Olivier | 285/331 |

FOREIGN PATENT DOCUMENTS

| | | | |
|---|---|---|---|
| EP | 530045 A1 | 3/1993 | E21B/7/06 |

OTHER PUBLICATIONS

Pending U.S. Appl. No. 10/367,535; filed Feb. 14, 2003; entitled: "*System and Method for Coupling a Steering Rib to a Rotary Steerable Directional Drilling Tool*", Inventors: Dagobert Feld, et al.

Pending U.S. Appl. No. 10/367,522; filed Feb 14, 2003; entitled: "*Saver Sub for a Steering Tool*", Inventors: Dagobert Feld, et al.

* cited by examiner

*Primary Examiner*—David Bagnell
*Assistant Examiner*—Shane Bomar
(74) *Attorney, Agent, or Firm*—Baker Botts L.L.P.

(57) ABSTRACT

According to one embodiment of the invention, a system for power generation inside a steering tool includes a drive system having a drive shaft disposed within a wall of the steering tool, a rotating shaft rotatably coupled to a non-rotating sleeve of the steering tool, and a spline coupled to the rotating shaft. The spline is operable to indirectly drive the drive shaft by directly coupling to an idler gear of the drive system.

25 Claims, 9 Drawing Sheets

STEERING TOOL POWER GENERATING SYSTEM AND METHOD

TECHNICAL FIELD OF THE INVENTION

This invention relates generally to the field of drilling systems and, more particularly, to a steering tool power generating system and method that facilitates more efficient and cost-effective drilling of well bores.

BACKGROUND OF THE INVENTION

Drilling well bores in the earth, such as well bores for oil and gas wells, is an expensive undertaking. One type of drilling system used is rotary drilling, which consists of a rotary-type rig that uses a sharp drill bit at the end of a drill string to drill deep into the earth. At the earth's surface, a rotary drilling rig often includes a complex system of cables, engines, support mechanisms, tanks, lubricating devices, and pulleys to control the position and rotation of the bit below the surface.

Underneath the surface, the drill bit is attached to a long drill string that transports drilling fluid to the drill bit. The drilling fluid lubricates and cools the drill bit and also functions to remove cuttings and debris from the well bore as it is being drilled.

Directional drilling involves drilling in a direction that in not necessarily precisely vertical to access reserves that are not directly beneath the drilling rig. Directional drilling involves turning of the drill bit while within the well bore. Off shore drilling often involves directional drilling because of the limited space beneath the offshore platform, although direction drilling is also vastly used on shore.

Various types of directional drilling tools exist. After a portion of a well is drilled, the drill bit is turned off, and a whip stock is inserted into the well bore to push the drill bit in the desired direction. This procedure is time consuming because the drill bit cannot rotate when it is being steered.

Another type of direction drilling involves bent subs in which a slight curvature of a bent sub steering of the drill string. To steer, rotation of the drill string is halted, but the drill bit continues to rotate powered by an associated mud motor. Because the bent sub is slightly angled and because the drill string is not rotating, the drill string is effectively steered in the direction of the bend of the bent sub. A measurement while drilling (MWD) system may be used such that accurate measurements may be made of the direction and location of the drill string.

Another type of direction drilling involves rotary steerable directional drilling, in which the drill string continues to rotate while steering takes place. Typically, a plurality of steering ribs are associated with the rotary steerable directional drilling tool to facilitate the steering. The ribs are disposed outwardly from a sleeve, inside of which is disposed a rotating shaft associated with the drill string. In one type of rotary steerable directional drilling tool, the outer sleeve rotates and in another the outer sleeve does not rotate. In the type in which the outer sleeve does not rotate, bearings allow relative movement between the outer sleeve and the rotating shaft.

SUMMARY OF THE INVENTION

According to one embodiment of the invention, a system for power generation inside a steering tool includes a drive system having a drive shaft disposed within a wall of the steering tool, a rotating shaft rotatably coupled to a non-rotating sleeve of the steering tool, and a spline coupled to the rotating shaft. The spline is operable to indirectly drive the drive shaft by directly coupling to an idler gear of the drive system.

DETAILED DESCRIPTION

The following description is directed to a rotary steerable directional drilling tool associated with a drill string that facilitates, among other things, more efficient and cost-effective drilling of well bores along a selected trajectory. In one embodiment of the invention, as described below, improved stability and centering of the tool within the well bore is provided by biasing steering ribs outwardly at pinned connections. In another embodiment, as described below, a self-centering saver sub that has an outward taper on its thread shoulder is provided. In another embodiment, as described below, the difference in the rotation of the drive shaft and the non-rotation of the sleeve of the rotary steerable directional drilling tool is utilized to generate electrical and hydraulic power via direct coupling. In this embodiment, to maintain the quality of the drilling and the reliability of the parts involved, there is a compliant mount for the gear sets and an overrunning clutch for the shafts of the respective electrical generator and hydraulic pump.

Embodiments of the invention may provide a number of technical advantages. In one embodiment, a rotary steerable directional drilling tool associated with a drill string facilitates more efficient and cost-effective drilling of well bores, while at the same time providing better quality and reliability. For example, improved stability and centering of the rotary steerable directional tool within the well bore is accomplished by biasing the steering ribs of the rotary steerable directional drilling tool outwardly. In addition, the rotary steerable directional drilling tool provides a self-centering saver sub that has an outward taper on its thread shoulder, which improves drilling quality and increases the reliability of the saver sub. Another technical advantage is that the difference in the rotation of the drive shaft and the non-rotation of the sleeve of the rotary steerable directional drilling tool is used to generate electrical and hydraulic power via direct coupling. To compensate for any unwanted loads or vibration during drilling, there is a compliant mount for the gear sets associated with the direct coupling and an overrunning clutch for the shafts of the respective electrical generator and hydraulic pump so as to maintain the quality of the drilling and the reliability of the parts involved.

Other technical advantages are readily apparent to one skilled in the art from the following figures, descriptions, and claims.

Figure 1:
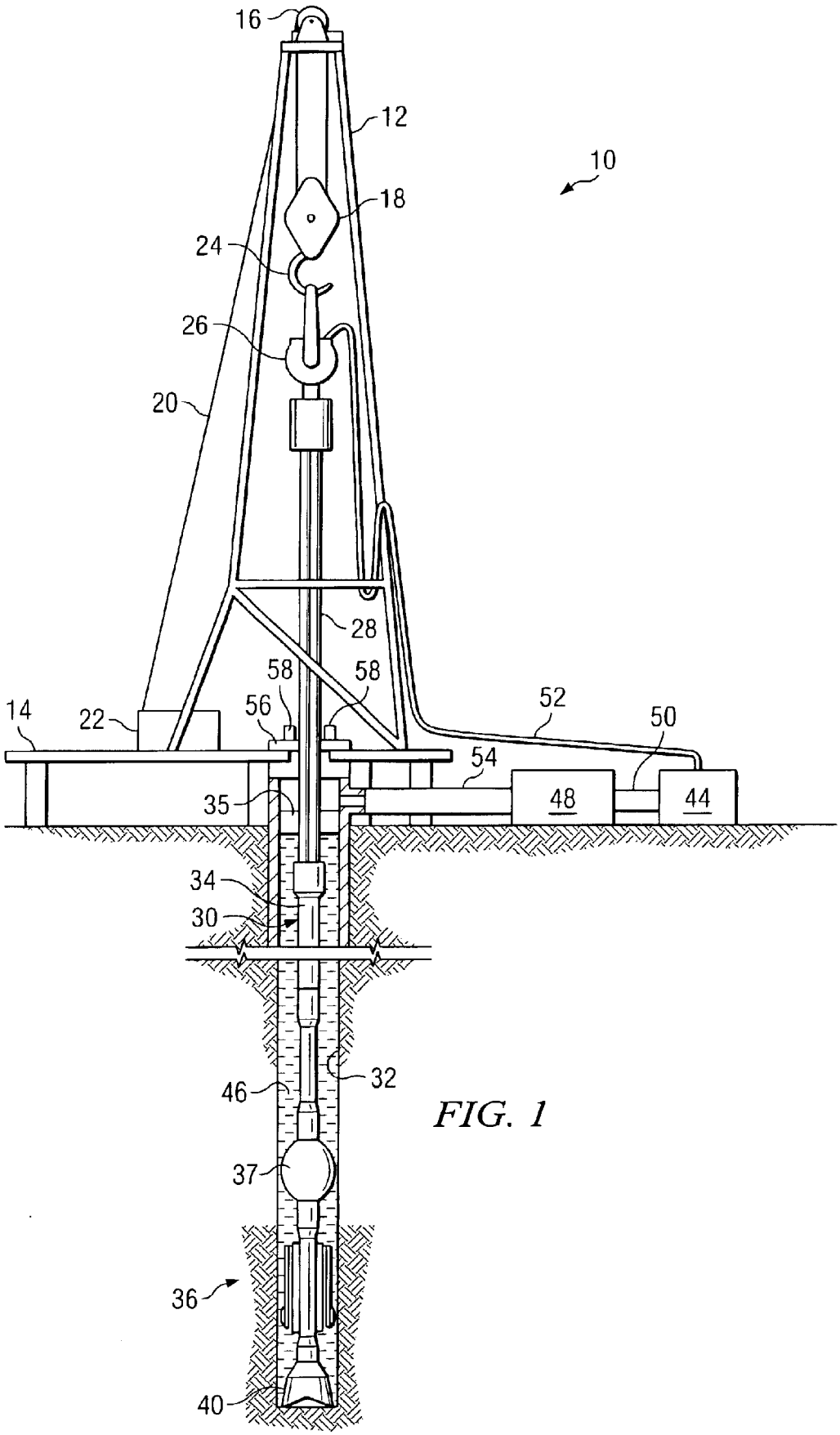
FIG. 1 is a schematic diagram of a drilling rig in accordance with one embodiment of the present invention.

FIG. 1 illustrates a drilling rig 10 in accordance with one embodiment of the present invention. In this embodiment, rig 10 is a conventional rotary table/kelly drive; however, the present invention contemplates other suitable drive devices for drilling rigs, such as top drive, power swivel, and down hole motor. Non-land rigs, such as jack up rigs, semi-submersibles, drill ships, mobile offshore drilling units (MODUs), and other suitable drilling systems that are operable to bore through the earth to resource-bearing or other geologic formations are also useful with the invention.

In the illustrated embodiment, rig 10 includes a mast 12 supported above a rig floor 14. A lifting gear associated with rig 10 includes a crown block 16 mounted to mast 12 and a travelling block 18. Crown block 16 and travelling block 18 are coupled by a cable 20 that is driven by draw works 22 to control the upward and downward movement of travelling block 18.

Travelling block 18 carries a hook 24 from which is suspended a swivel 26. Swivel 26 supports a kelley 28, which in turn supports a drill string, designated generally by the numeral 30, in a well bore 32. A blow out preventor (BOP) 35 is positioned at the top of well bore 32. Drill string 30 may be held by slips 58 during connections and rig-idle situations or at other appropriate times.

Drill string 30 includes a plurality of interconnected sections of drill pipe 34, one or more stabilizers 37, a rotary steerable directional drilling tool 36, and a rotary drill bit 40. Drill pipe 34 may be any suitable drill pipe having any suitable diameter and formed from any suitable material. Rotary steerable directional drilling tool 36, which is described in greater detail below in conjunction with FIGS. 2, 3A and 3B, generally functions to control the drilling direction of drill bit 40. Rotary drill bit 40 functions to bore through the earth when drill string 30 is rotated and weight is applied thereto. Drill string 30 may include different elements or more or fewer elements than those illustrated depending on the type of drilling system. For example, drill string 30 may also include drill collars, measurement well drilling (MWD) instruments, and other suitable elements and/or systems.

Mud pumps 44 draw drilling fluid, such as mud 46, from mud tanks 48 through suction line 50. A "mud tank" may include any tank, pit, vessel, or other suitable structure in which mud may be stored, pumped from, returned to, and/or recirculated. Mud 46 may include any suitable drilling fluids, solids or mixtures thereof. Mud 46 is delivered to drill string 30 through a mud hose 52 connecting mud pumps 44 to swivel 26. From swivel 26, mud 46 travels through drill string 30 and rotary steerable directional drilling tool 36, where it exits drill bit 40 to scour the formation and lift the resultant cuttings through the annulus to the surface. At the surface, mud tanks 48 receive mud 46 from well bore 32 through a flow line 54. Mud tanks 48 and/or flow line 54 include a shaker or other suitable device to remove the cuttings.

Mud tanks 48 and mud pumps 44 may include trip tanks and pumps for maintaining drilling fluid levels in well bore 32 during tripping out of hole operations and for receiving displaced drilling fluid from the well bore 32 during tripping-in-hole operations. In a particular embodiment, the trip tank is connected between well bore 32 and the shakers. A valve is operable to divert fluid away from the shakers and into the trip tank, which is equipped with a level sensor. Fluid from the trip tank may then be directly pumped back to well bore 32 via a dedicated pump instead of through the standpipe.

Drilling is accomplished by applying weight to drill bit 40 and rotating drill string 30, which in turn rotates drill bit 40. Drill string 30 is rotated within well bore 32 by the action of a rotary table 56 rotatably supported on the rig floor 14. Alternatively, or in addition, a down hole motor may rotate drill bit 40 independently of drill string 30 and the rotary table 56. As previously described, the cuttings produced as drill bit 40 drills into the earth are carried out of well bore 32 by mud 46 supplied by pumps 44. To direct or "steer" drill bit 40 in a desired direction, drill string 30 includes rotary steerable directional drilling tool 36 adjacent to drill bit 40.

Figure 2:
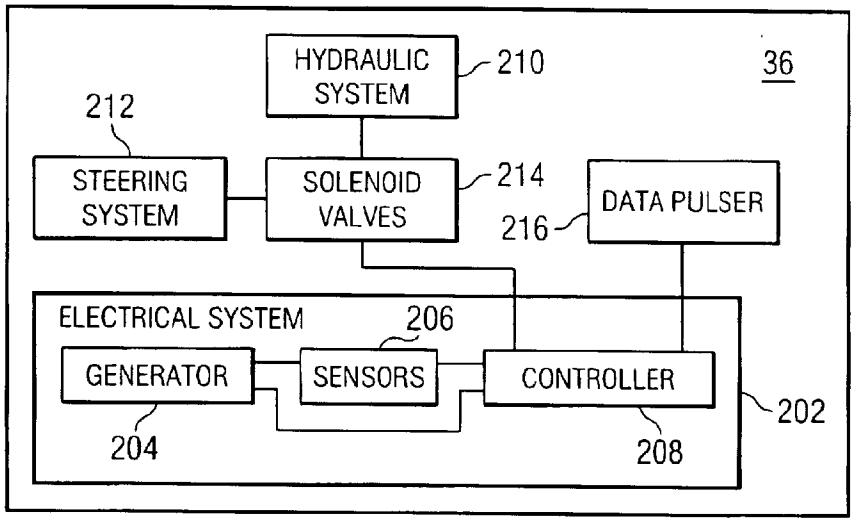
FIG. 2 is a functional block diagram of a steering tool associated with a drill string of the drilling rig of FIG. 1 in accordance with one embodiment of the present invention.

FIG. 2 is a functional block diagram of rotary steerable directional drilling tool 36 illustrating some of the components of rotary steerable directional drilling tool 36 in accordance with one embodiment of the present invention. As illustrated, rotary steerable directional drilling tool 36 includes an electrical system 202, a hydraulic system 210, a steering system 212, solenoid valves 214, and a data pulser 216.

Electrical system 202 includes a generator 204, a plurality of sensors 206, and a controller 208. Generally, generator 204 provides the electrical power for rotary steerable directional drilling tool 36. A separate power source (not shown) may also, be provided in addition to generator 204 to provide additional power or to provide backup power to rotary steerable directional drilling tool 36. Generator 204, which is described in greater detail below in conjunction with FIGS. 3A and 3B, may also be used to provide power to other elements, components, or systems associated with either rotary steerable directional drilling tool 36 or drill string 30.

Sensors 206 may include any suitable sensors or sensing systems that are operable to monitor, sense, and/or report characteristics, parameters, and/or other suitable data associated with rotary steerable directional drilling tool 36, drill bit 40, or the conditions within well bore 32. For example, sensors 206 may include conventional industry standard triaxial magnetometers and accelerometers for measuring inclination, azimuth, and tool face parameters. The sensed characteristics, parameters, and/or data is typically automatically sent to controller 208; however, sensors 206 may send the characteristics, parameters, and/or data to controller 208 in response to queries by controller 208.

Generally, controller 208 provides the "brains" for rotary steerable directional drilling tool 36. Controller 208 is any suitable down hole computer or computing system that is operable to receive sensed characteristics or parameters from sensors 206 and to communicate the sensed characteristics or parameters to the surface so that drilling personnel may monitor the drilling process on a substantially real-time basis, if so desired. The data communicated to the surface may be processed by controller 208 before communication to the surface or may be communicated to the surface in an unprocessed state. Controller 208 communicates data to the surface using any suitable communication method, such as controlling data pulser 216.

Data pulser 216 may be any suitable transmission system operable to generate a series of mud pulses in order to transmit the data to the surface. Typically, mud pulses are created by controlling the opening and closing of a valve associated with data pulser 216, thereby allowing a small volume of mud to divert from inside drill string 30 into an annulus of well bore 32, bypassing drill bit 40. This creates a small pressure loss, known as a "negative pulse" inside drill string 30, which is detected at the surface as a slight drop in pressure. The controlling of the valve associated with data pulser 216 is controlled by controller 208. In this manner, data may be transmitted to the surface as a coded sequence of pressure pulses. Alternate types of pulses that may be used momentarily restrict mud flow inside the pipe. This type is referred to as a "positive pulse."

Hydraulic system 210, which is described in greater detail below in conjunction with FIGS. 3A and 3B, generally functions to provide hydraulic pressure to steering system 212 so that steering ribs associated with steering system 212 may be actuated in a predetermined manner to facilitate the steering of drill bit 40. The steering ribs, which are described in greater detail below in conjunction with FIGS. 4A through 4F, are part of steering system 212 along with associated pistons that function to "push out" a respective steering rib when a respective solenoid valve 214 is opened by electrical system 202. Solenoid valves 214 may be any suitable solenoid valves that are operable to allow hydraulic fluid to pass through hydraulic passages for the purpose of actuating steering ribs via pistons. Controller 208 may function to control the opening and closing of solenoid valves 214.

Figure 3A:
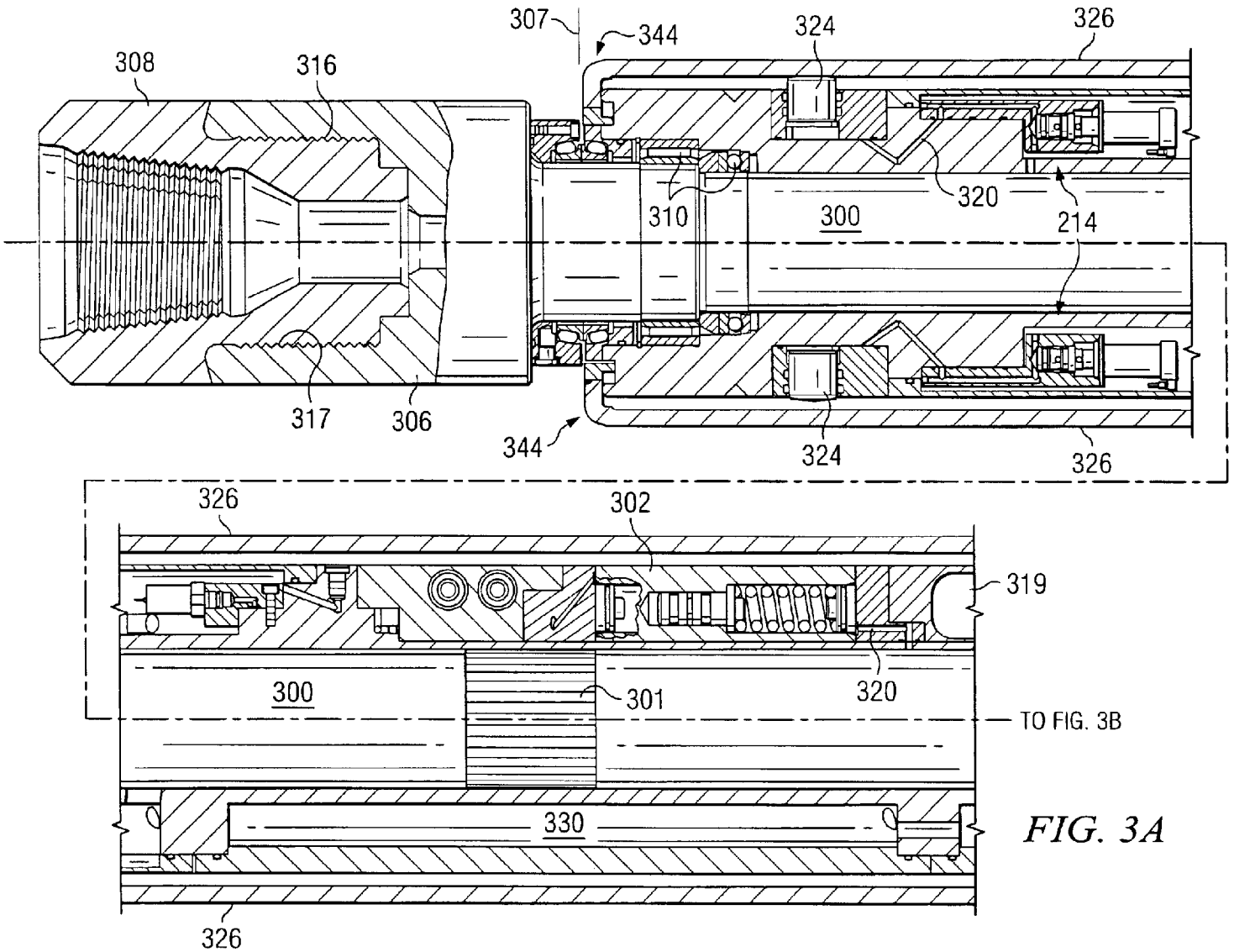
FIGS. 3A, 3B, 4A and 4B are elevation views, in partial cross-section, of an example steering tool in accordance with one embodiment of the present invention.
Figure 3B:
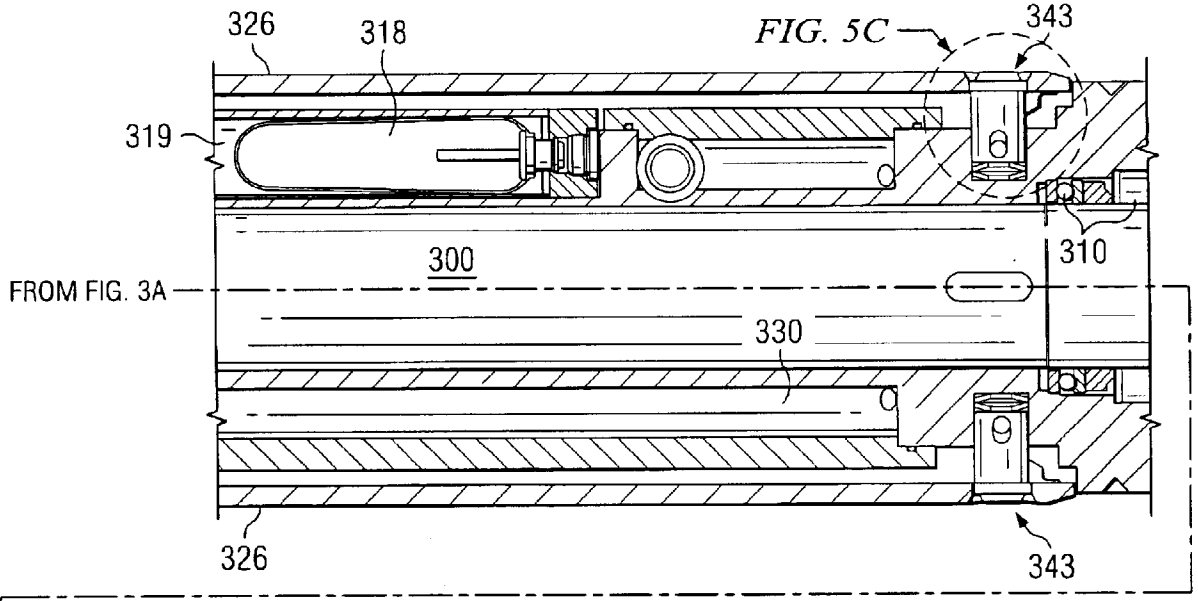
Figure 3B:
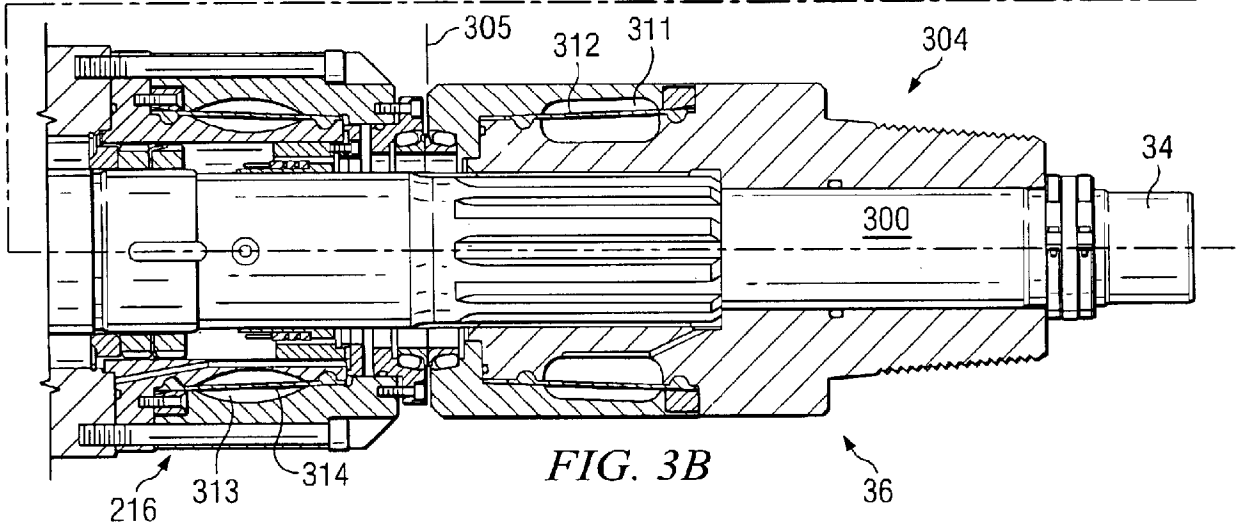
Figure 4A:
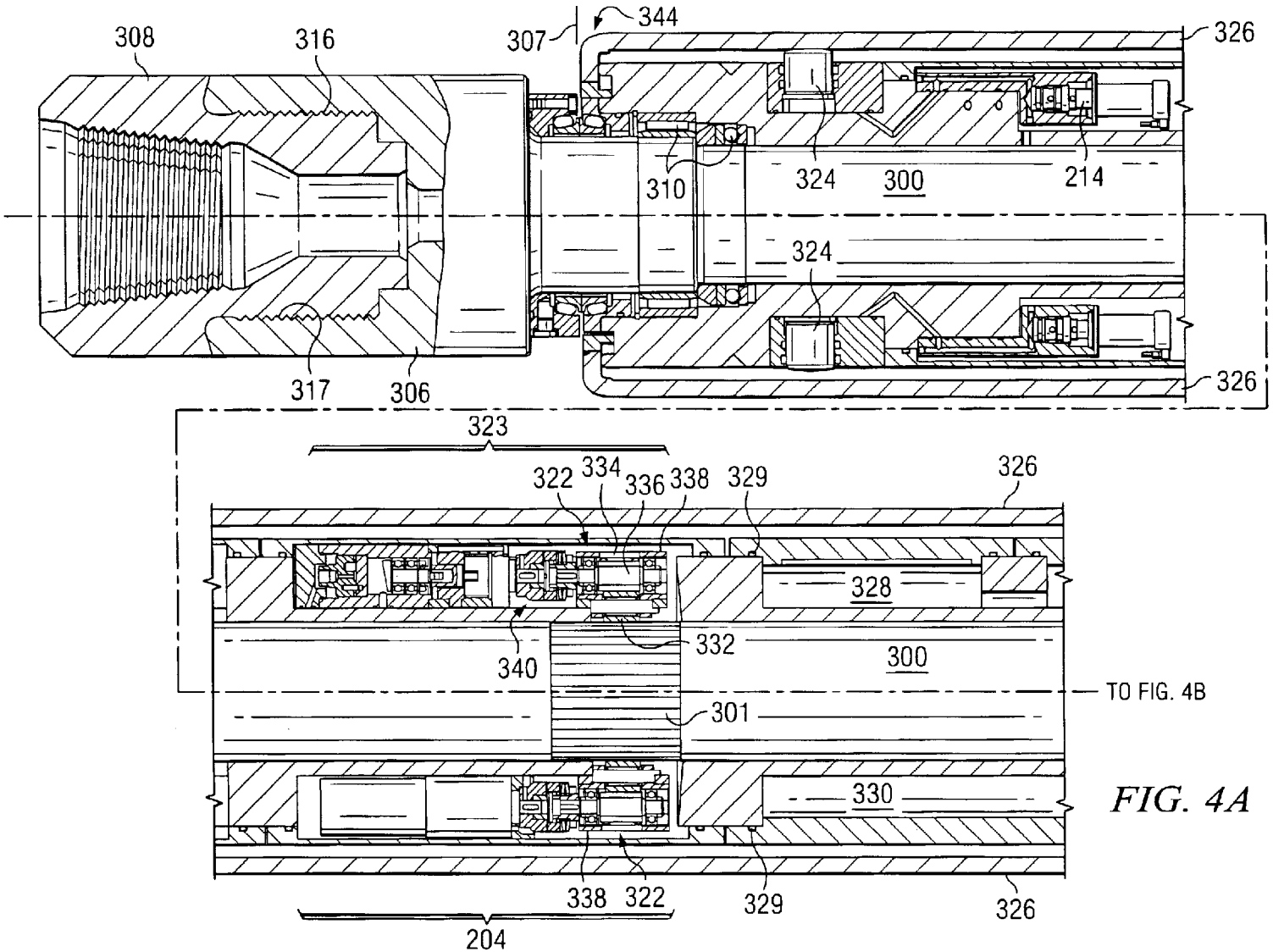
Figure 4B:
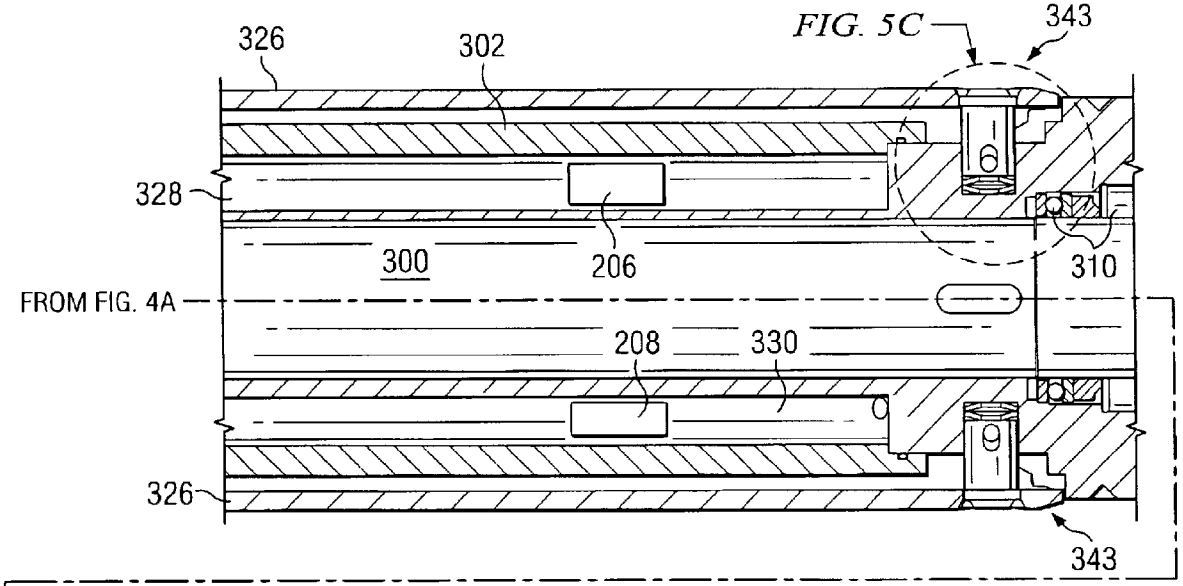
Figure 4B:
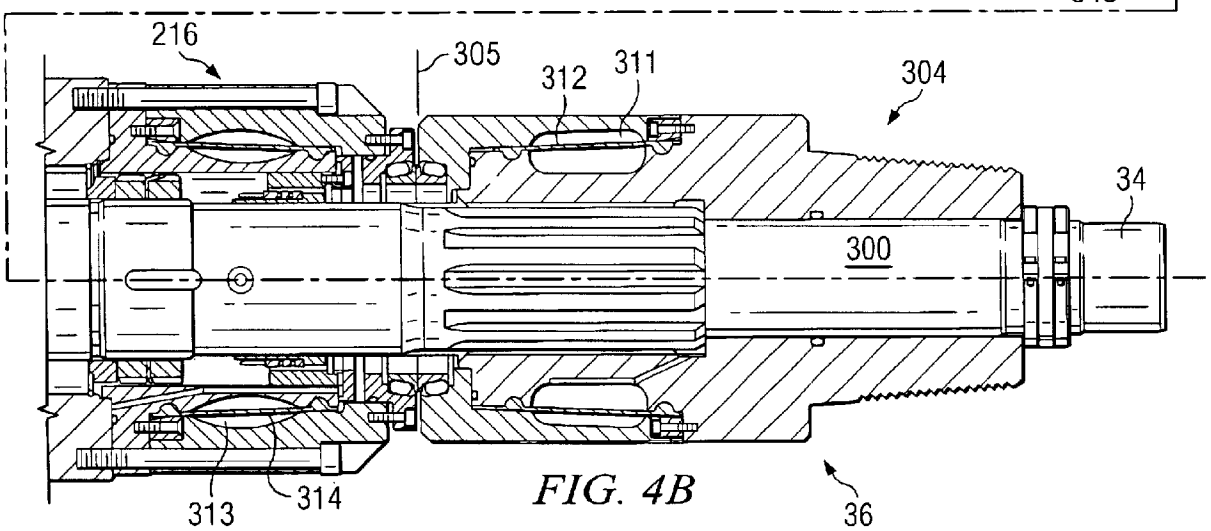

FIGS. 3A, 3B, 4A and 4B are elevation views, in partial cross-section, of an example rotary steerable directional drilling tool 36 in accordance with one embodiment of the present invention. FIGS. 3A and 3B illustrate a cross-section of rotary steerable directional drilling tool 36 at a rotational angle that is approximately 90 degrees from the cross-section that is illustrated in FIGS. 4A and 4B.

In the embodiment illustrated in FIGS. 3A through 4B, rotary steerable directional drilling tool 36 includes a rotating shaft generally referred to as the "drive shaft" 300 rotatably coupled within a non-rotating housing or sleeve 302, a head end 304, a box end 306, and a saver sub 308. Rotating shaft 300 is a hollow shaft having any suitable diameter and formed from any suitable material that is coupled to drill pipe 34 via head end 304 and coupled to drill bit 40 (not explicitly shown) via saver sub 308. In one embodiment, rotating shaft 300 is formed from non-magnetic alloy so that magnetometers used with rotary steerable directional drilling tool 36 operate properly. In general, elements of rotary steerable directional drilling tool 36 that are to the right of a line 305 rotate and elements of rotary steerable directional drilling tool 36 that are to the left of a line 307 rotate with the drill pipe. Elements of rotary steerable directional drilling tool 36 that are between lines 305 and 307 do not rotate (with the exception of rotating shaft 300 and any rotating shafts or gears associated with electrical system 202 and hydraulic system 210).

To drill well bore 32, weight is applied to drill bit 40 and drilling commences by rotating drill pipe 34, which rotates head end 304, rotating shaft 300, box end 306, saver sub 308, and drill bit 40 (not explicitly shown). Concurrently, drilling fluid, such as mud 46, is circulated down through drill pipe 34, rotating shaft 300, and saver sub 308 before exiting drill bit 40 and returning to the surface in the annulus formed between the wall of well bore 32 and the outside surfaces of rotary steerable directional drilling tool 36 and drill pipe 34. Rotating shaft 300 is able to rotate within non-rotating sleeve 302 by utilizing one or more bearings 310. Any suitable bearings 310 may be utilized, such as roller bearings, journal bearings, and the like.

Rotating shaft 300 includes splines 301 formed thereon. As described in greater detail below, splines 301 function to transfer rotational energy of rotating shaft 300 to drive shafts of drive systems 322 (FIG. 4A) associated with generator 204 of electrical system 202 and a hydraulic pump of hydraulic system 210. Splines 301 may be coupled to rotating shaft 300 in any suitable manner; in a particular embodiment, spline 301 is formed integrally with rotating shaft 300.

Head end 304 may be coupled to drill pipe 34 in any suitable manner. Head end 304 includes a pressure compensation chamber 311 having an associated rubber bladder 312 that functions to keep internal pressure of an oil system substantially the same as hydrostatic pressure of the mud in the well bore. An additional pressure compensation chamber 313 having an associated rubber bladder 314 is associated with data pulser 216 (FIGS. 3B and 4B), which is disposed at the upper end of non-rotating sleeve 302.

Box end 306 couples to rotating shaft 300 in any suitable manner. In a particular embodiment, box end 306 is formed integral with rotating shaft 300. Box end 306 has internal threads 316 that function to accept external threads 317 of saver sub 308 in order to couple saver sub 308 to box end 306. Saver sub 308, which is described in greater detail below in conjunction with FIG. 8, functions to couple drill bit 40 thereto and protects box end 306 from damage arising from repeated threading/unthreading of drill bit 40.

Non-rotating sleeve 302 houses many of the components of electrical system 202, hydraulic system 210, steering system 212, and data pulser 216, as well as solenoid valves 214, as described in greater detail below. Non-rotating sleeve 302 also includes a plurality of steering ribs 326 coupled to an outer surface of non-rotating sleeve 302. Steering ribs 326 may be considered to be part of steering system 212. Non-rotating sleeve 302 may be formed from any suitable material, usually non-magnetic. Some components associated with non-rotating sleeve 302 may be adversely affected by magnetic fields; therefore, the material used to house these elements, such as the elements of electrical system 202, are preferably made of a non-magnetic material, such as monel or other suitable non-magnetic material.

Components of hydraulic system 210 include a hydraulic fluid reservoir 318 (FIG. 3B), a plurality of hydraulic fluid passages 320 (some of which are not shown for clarity purposes), and hydraulic pump 323. Reservoir 318 is disposed in a compartment 319 (FIG. 3B) in the wall of non-rotating sleeve 302. Reservoir 318 houses any suitable hydraulic fluid used to translate pistons 324 for the purpose of actuating steering ribs 326 in order to steer drill bit 40. Hydraulic passages 320, which may be formed in the wall of non-rotating sleeve 302 in any suitable manner and in any suitable location, transport hydraulic fluid from reservoir 318 to pistons 324. Hydraulic pump 323 is used to pressurize the hydraulic fluid so there is adequate force exerted on the underside of pistons 324 in order to translate them.

Components of electrical system 202 include generator 204 (FIG. 4A), sensors 206 (FIG. 4B), and controller 208 (FIG. 4B). As described above, generator 204 is used to provide power to solenoid valves 214, sensors 206, and controller 208. For example, at the appropriate time, controller 208 directs a particular solenoid valve 214 to open so that pressurized hydraulic fluid may translate a particular piston 324 in order to actuate a particular steering rib 326 for the purpose of steering drilling bit 40 in a desired direction.

Sensors 206, as described above, operate to sense various characteristics and parameters of the drilling process so that data that is indicative of the sensed characteristics and parameters may be transmitted to the surface in order to effectively control the drilling process form the surface. The measurements from the sensors also cause the controller to operate the steering system to steer the bit along a pre-programmed trajectory. Sensors 206, which may be self-powered in some embodiments, are housed in one or more compartments 328 (FIG. 4B) that are formed in the wall of non-rotating sleeve 302. Compartments 328 are sealed from the environment on the outside of rotary steerable directional drilling tool 36 by any suitable number and type of seals 329. Similarly, controller 208 is housed in one or more compartments 330 (FIG. 4B) that are also formed in the wall of non-rotating sleeve 302. Compartments 330 may also be sealed from the environment on the outside of non-rotating sleeve 302 by appropriate seals 329.

Both hydraulic pump 323 and generator 204 are driven as a result of the difference in rotation speed between rotating shaft 300 and the non-rotation of non-rotating sleeve 302. The details of how this works is described further below in conjunction with FIG. 6. However, in one example, generally, spline 301 rotates a gear 332 which in turn rotates a gear 334. The rotation of a shaft 336 associated with gear 334 functions to provide the energy for driving hydraulic pump 323.

To compensate for any vibration or movement of rotating shaft 300 as a result of the drilling process, a gear casing 616 (FIG. 6) associated with each drive system 322 is engaged with a compliant mount 338. Compliant mount 338 functions to assure the continued correct operation of drive system 322 by reducing or eliminating the risk of damage due to vibration or lateral movement of rotating shaft 300. Compliant mount 338 may be formed from any suitable material, such as rubber, and is coupled to non-rotating sleeve 302 in any suitable manner.

The reliability of drive systems 322 is also aided by the use of an overrunning clutch 340, the details of which are described below in conjunction with FIGS. 7A and 7B. Generally, overrunning clutch 340 functions to prevent any damage to drive system 322 based on any sudden changes in the rotation speed of rotating shaft 300. For example, if for some reason rotating shaft 300 were to stop immediately from rotating, then overrunning clutch 340 disengages and allows the connecting shaft to slow down at a safe speed. Further details of this operation are described below in conjunction with FIGS. 7A and 7B.

Steering ribs 326 are coupled to non-rotating sleeve 302 at one end via pinned connections 342. The details of a particular pinned connection 342 is described below in conjunction with FIG. 5C and 5D. Generally, steering ribs 326 are pinned to the wall of non-rotating sleeve 302 such that the upper end 343 of steering ribs 326 are biased outwardly from non-rotating sleeve 302 so that the outside surface of each of the steering ribs 326 contacts the wall of well bore 32. The lower end 344 of each of the steering ribs 326 rests on pistons 324 so that when a particular piston 324 is translated outwardly, the associated steering rib 326 is pressed against the wall of well bore 32 so that drill bit 40 may be steered in a desired direction. Typically, there are four steering ribs 326 spaced approximately an equal circumferential distance apart around non-rotating sleeve 302; however, any number of steering ribs 326 may be used. Additional details of steering ribs 326, their function, and pinned connection 342 are described below in conjunction with FIGS. 5A through 5F.

Figure 5A:
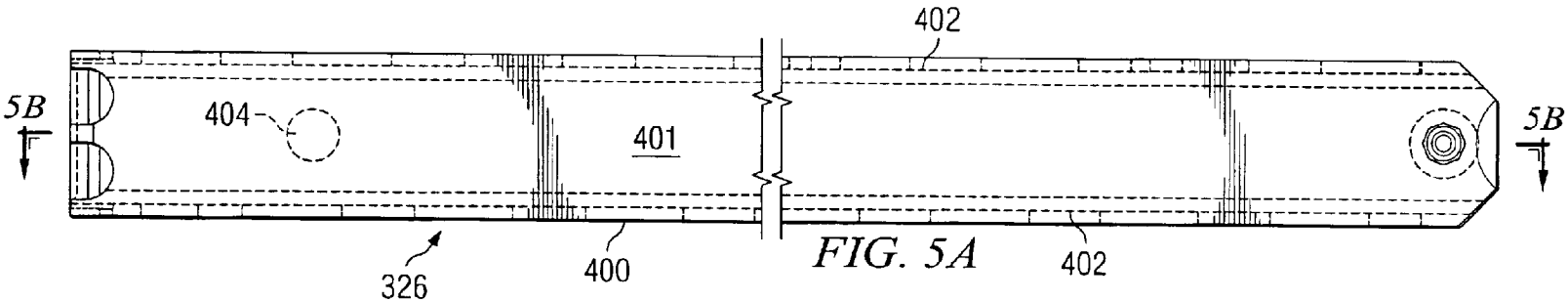
FIGS. 5A and 5B are plan and elevational views, respectively, of a steering rib of the steering tool of FIGS. 3A through 4B in accordance with one embodiment of the present invention.
Figure 5B:
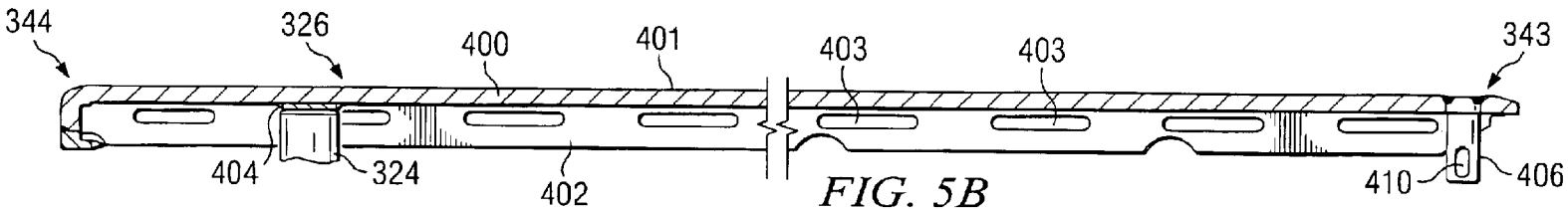

FIGS. 5A and 5B are plan and elevational views, respectively, of an exemplary steering rib 326 of rotary steerable directional drilling tool 36 in accordance with one embodiment of the present invention. Each steering rib 326 includes a main body 400 having a bearing surface 401, a pair of stiffeners 402, a piston bearing member 404, and a mounting pin 406. Steering rib 326 may be formed from any suitable material and may have any suitable dimensions. In one embodiment, steering rib 326 is generally rectangularly shaped, having a width of approximately three to five inches and a length of approximately three to four feet. As described above, steering ribs 326 function to steer drill bit 40 in a desired direction when a lower end 344 of steering rib 326 is actuated radially by a respective piston 324 (FIG. 5B) such that bearing surface 401 applies a force to the wall of well bore 32. The function of steering ribs 326 is described in more detail below in conjunction with FIGS. 5E and 5F.

Although bearing surface 401 may have any suitable profile, preferably bearing surface 401 has a curved profile that substantially matches the profile of the wall of well bore 32 so that an evenly distributed load may be applied thereto.

Stiffeners 402 provide stiffness to steering rib 326 to avoid any buckling or other unwanted deflection of steering rib 326. In addition, stiffeners 402 ensure that the bearing force provided by piston 324 onto piston bearing member 404 is applied substantially evenly to the wall of well bore 32. Stiffeners 402 may have one or more slots 403 formed therein that aid in the prevention of any mud flowing through well bore 32 of getting stuck and clogging up steering ribs 326 and preventing their correct operation.

Piston bearing member 404 may have any suitable shape and any suitable thickness and may be coupled to the underside of main body 400 in any suitable manner, such as welding. In the illustrated embodiment, piston bearing member 404 is a circular plate. Piston bearing member 404 is located toward lower end 344 such that when steering rib 226 is installed onto rotary steerable directional drilling tool 36, a respective piston 324 is directly underneath piston bearing member 404. Piston bearing member 404 transfers the force from piston 324 through main body 400 and into the wall of well bore 32 so that steering rib 326 may direct drill bit 40 in a desired direction.

Figure 5D:
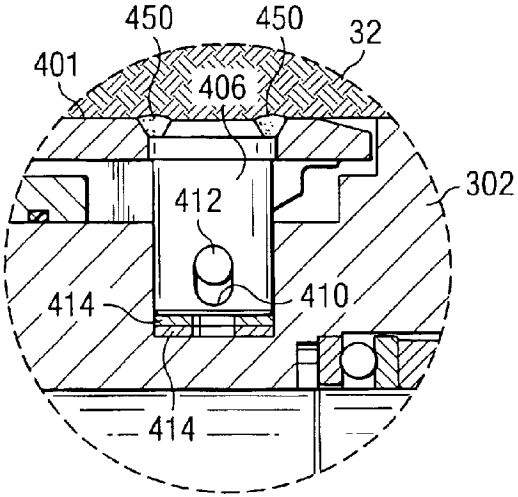
FIGS. 5C and 5D are elevation views of a pinned connection of the steering rib of FIGS. 5A and 5B to the steering tool of FIGS. 3A through 4B in accordance with one embodiment of the present invention.
Figure 5C:
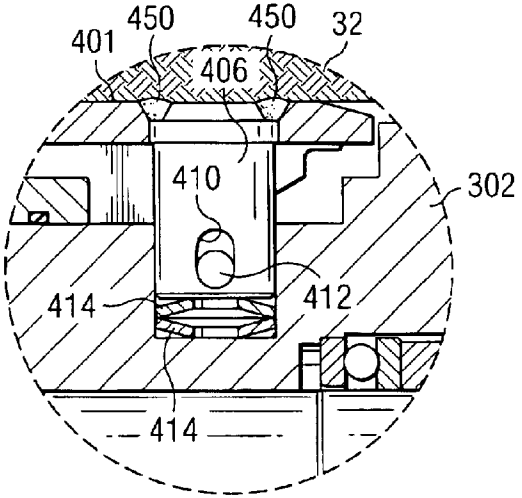

Pin 406 is used to couple steering rib 326 to rotary steerable directional drilling tool 36, as described further below in conjunction with FIGS. 5C and 5D. In one embodiment, pin 406 is a cylindrical steel bar, and is welded to the upper end 343 of steering rib 326 with one or more weld beads 450. However, pin 406 may take on other suitable forms and may be coupled to steering rib 326 in other suitable manners. Weld beads 450 are illustrated in FIGS. 5C and 5D. In a particular embodiment, weld beads 450 are applied to the outer surface of steering rib 326 to provide additional grip on the wall of well bore 32. Weld beads 450 may be applied on any suitable location along the outer surface of steering rib 326. This additional grip aids in preventing rotation of non-rotating sleeve 302 within well bore 32.

According to one embodiment of the present invention, pin 406 has a slot 410 formed therein that allows upper end 343 to be biased outwardly toward the wall of well bore 32 when steering rib 326 is coupled to rotary steerable directional drilling tool 36 and when a force is outwardly applied to upper end 343. This force may be applied by a pair of spring washers 414 (FIGS. 5C and 5D) or other suitable force-transmitting members. Biasing upper end 343 outwardly against the wall of well bore 32 helps prevent rotation of non-rotating sleeve 302 that might otherwise occur due to coupling of non-rotating sleeve 302 to rotating shaft 300. Slot 410 may have any suitable dimensions; however, in one embodiment, slot 410 has a width of ¼ inch and a length of ⅜ inch.

Referring to FIGS. 5C and 5D, steering rib 326 is shown to be coupled to non-rotating sleeve 302 of rotary steerable directional drilling tool 36 via a connector 412 disposed through slot 410 of pin 406. As illustrated in FIG. 5C, spring washers 414 apply a force outwardly against pin 406 such that bearing surface 401 presses against the wall of well bore 32 (not shown) during drilling operations. The force applied may be any suitable force; however, in one embodiment, the force applied is approximately fifty pounds. In the illustrated embodiment, spring washers 414 are disposed in a cavity 415 formed in the wall of non-rotating sleeve 302. As illustrated in FIG. 5D, when the reaction force from the wall of well bore 32 is greater than the spring force transmitted by spring washers 414, then spring washers 414 compress, and upper end 343 of steering rib 326 is pushed inward until connector 412 stops pin 406 from moving by reaching the end of slot 410. Spring washers 414, in one embodiment, are Belleville washers; however, other suitable spring washers may be utilized. In other embodiments, springs or other suitable resilient members may be utilized in place of spring washers 414. Furthermore, spring washers 414 can also fit between the inner surface of steering rib 326 and the outer surface. A technical advantage of using spring washers 414 to bias upper ends 343 of steering ribs 326 outwardly towards the wall of well bore 32 is that they provide for stability and centering of rotary steerable directional drilling tool 36 within well bore 32, as well as preventing rotation of non-rotating sleeve 302. This facilitates, among other things, more precise turning of drill bit 40 and a more efficient drilling operation.

Figure 5F:
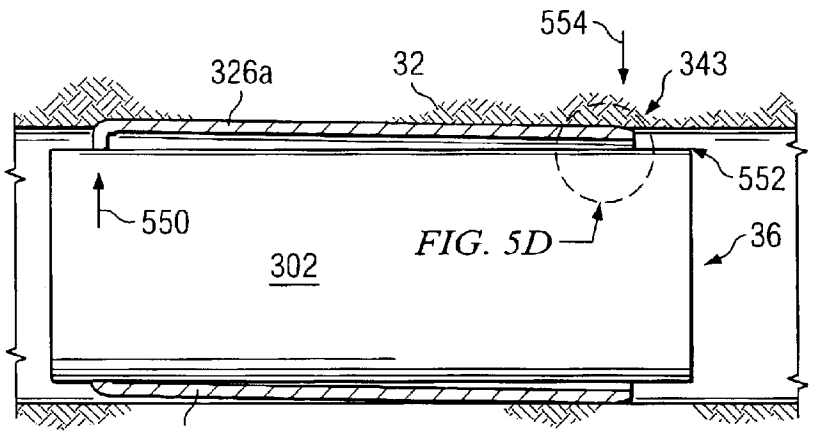
FIGS. 5E and 5F are elevation views illustrating the general function of the steering ribs of FIGS. 3A through 4B.
Figure 5E:
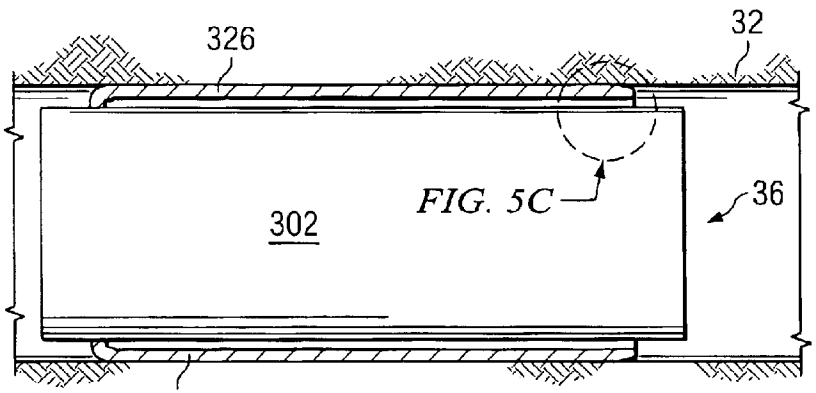

Referring to FIGS. 5E and 5F, the general function of steering ribs 326 is illustrated. In FIG. 5E, a "normal" position of rotary steerable directional drilling tool 36 is shown in which the steering ribs 326 are biased outwardly to contact the wall of well bore 32. The position of connector 412 within slot 410 during this biasing is best illustrated in FIG. 5C. When drill bit 40 (not explicitly shown) needs to be turned, then, as illustrated in FIG. 5F, a steering rib 326*a* is actuated outwardly at its lower end (the extent of outer movement is exaggerated in this view for clarity purposes), as denoted by arrow 550, creating a force that steers rotary steerable directional tool in a direction opposite that of arrow 550. This movement may result in a reaction force (as denoted by arrow 554) from the wall of well bore 32 that is greater than the spring force from spring washers 414 such that end 343 of steering rib 326 is pushed inwardly until, as illustrated in FIG. 5D, connector 412 stops pin 406 from moving by reaching the end of slot 410. Reaction force 554 may be caused by conditions within well bore 32 other than only the turning of drill bit 40.

Figure 6:
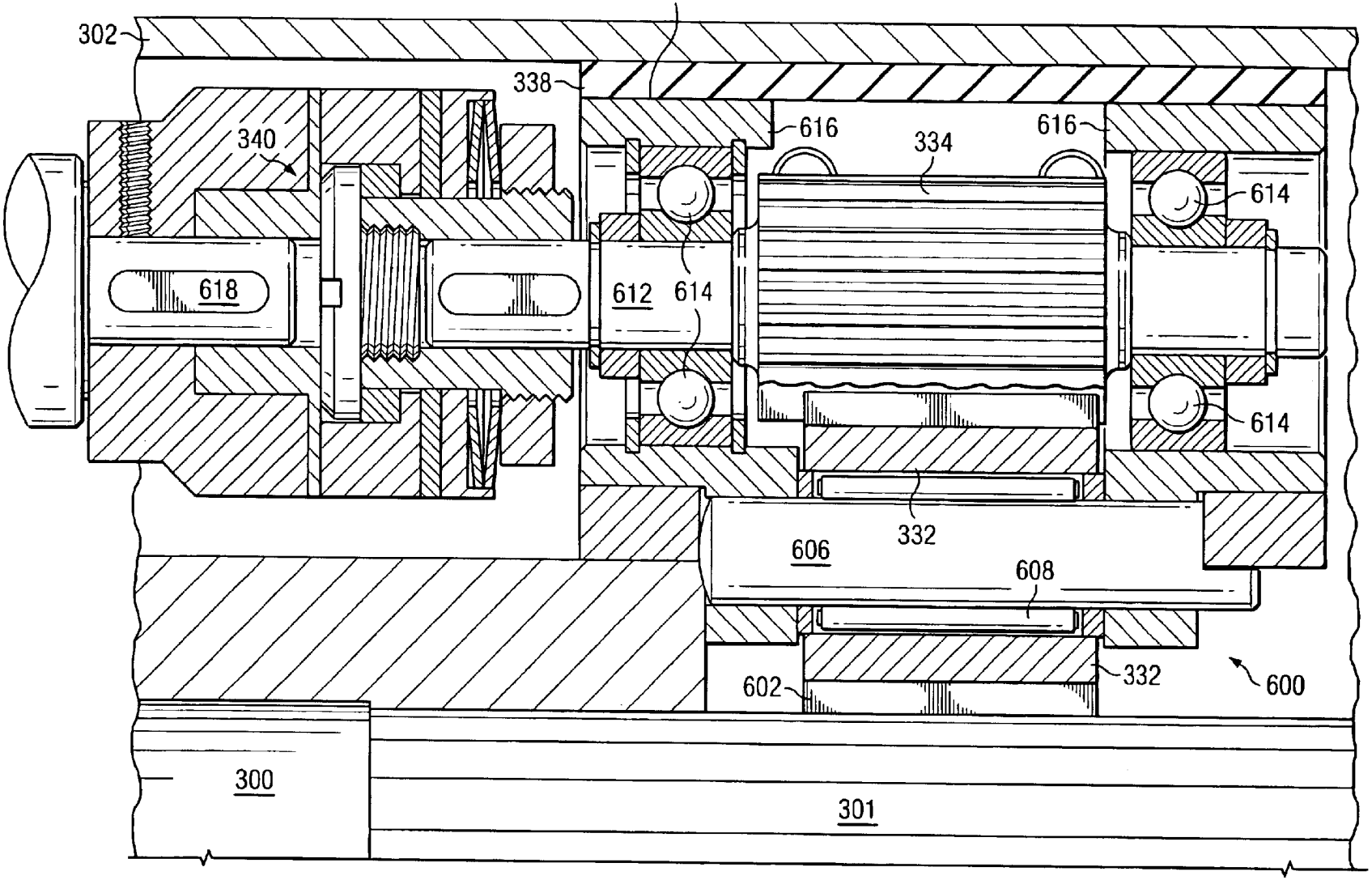
FIG. 6 is a cross-sectional view of a drive system of the steering tool of FIGS. 3A through 4B in accordance with one embodiment of the present invention.

FIG. 6 is a cross-sectional view of an example drive system 322 (FIG. 4A) of rotary steerable directional drilling tool 36 in accordance with one embodiment of the present invention. As illustrated in FIG. 6, a respective drive system 600 may be used to drive hydraulic pump 323 of hydraulic system 210 and generator 204 of electrical system 202. According to one embodiment of the present invention, there is a direct coupling of rotating shaft 300 to drive system 600. To facilitate this direct coupling, splines 301 of rotating shaft 300 mesh with gear 332 that rotates around a shaft 606 via roller bearings 608. The rotation of gear 332 rotates gear 334 coupled to an output shaft 612 that is supported by roller bearings 614 in gear casing 616. The rotating of output shaft 612 is transferred to a drive shaft 618 via overrunning clutch 340. Drive shaft 618 subsequently provides the energy for generator 204 and hydraulic pump 323. Overrunning clutch 340 is described in detail below in conjunction with FIGS. 7A and 7B.

Because of the difference in the pitch circle diameters of spline 301 and gear 334, output shaft 612 has a much greater rotational speed than rotating shaft 300, in one embodiment. Typically, output shaft 612 rotates anywhere from 15,000 to 20,000 rpm, which generates approximately 100 watts of power for generator 204. Because of the forces encountered in drilling operations and the fact that rotating shaft 300 has a smaller outside diameter than the inside diameter of non-rotating sleeve 302, rotating shaft 300 may be laterally displaced during the drilling process. Because spline 301 is coupled to rotating shaft 300 and meshes with gear 332, which in turn meshes with gear 334, any lateral displacement or movement of rotating shaft 300 may damage gear 332 and gear 334 and, hence, damage drive system 600. To alleviate this situation and potential damage, compliant mount 338 is disposed between an outside surface 620 of gear casing 616 and inside surface of the wall of non-rotating shaft 302. Compliant mount 338 is formed from any suitable resilient material, such as rubber or other elastomer, to allow the gears 332 and 334 to move in conjunction with the movement of rotating shaft 300, thereby preventing damage to drive system 600.

Additionally, the rotational speed of drive shaft 300 is not constant during the drilling operation. There may be times where rotating shaft 300 either abruptly stops or abruptly slows to a lesser rotating speed. This abrupt change in rotational speed may damage drive shaft 618 and the components attached thereto. This is one reason overrunning clutch 340 is utilized. Details of one example of overrunning clutch 340 are described below in connection with FIGS. 7A and 7B.

Figures 7A, 7B, 8:
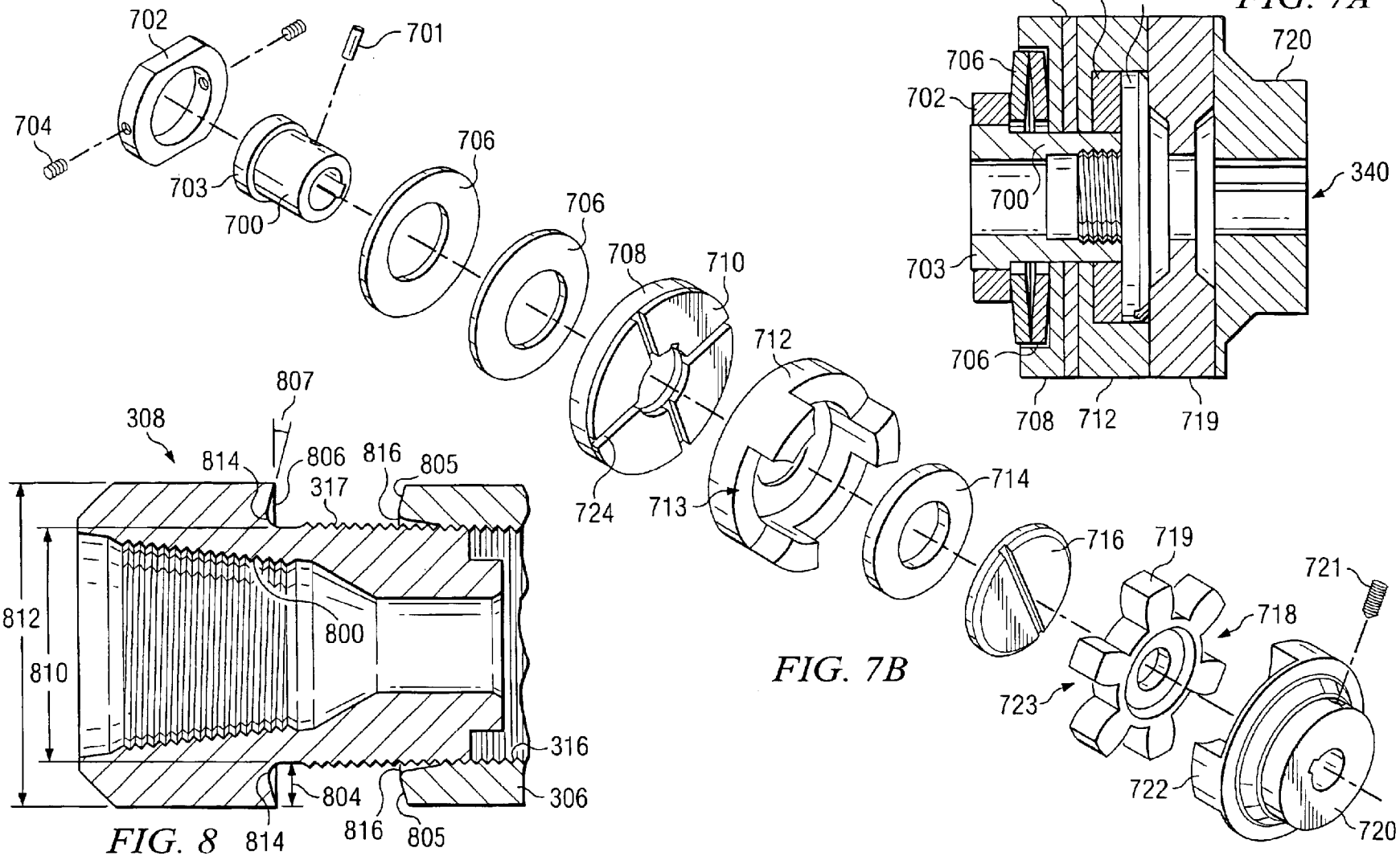
FIGS. 7A and 7B are cross-sectional and exploded perspective views, respectively, of an overrunning clutch of the drive system of FIG. 6 in accordance with one embodiment of the present invention.
FIG. 8 is a cross-sectional view of a saver sub in accordance with one embodiment of the present invention.

FIGS. 7A and 7B are cross-sectional and exploded perspective views, respectively, of overrunning clutch 340 in accordance with one embodiment of the present invention. In the illustrated embodiment, and with reference to FIG. 7B, overrunning clutch 340 includes a driving hub 700 that couples to output shaft 612 (FIG. 6) via a cylindrical pin 701, an adjustment nut 702 coupled to a collar 703 of driving hub 700 with one or more set screws 704, a pair of spring washers 706, a pressure washer 708 having a friction facing 710, a drive coupling 712, a washer 714, a lock screw 716, a resilient member 718, and a clutch pawl 720 that couples to drive shaft 618 with a set screw 721.

The rotation of output shaft 612 is transferred to drive shaft 618 by the interface of friction facing 710 of pressure washer 708 and drive coupling 712. Friction facing 710 has one or more troughs 724 formed therein that allow any debris generated from near of the facing 710 to flow away from facing 710. Spring washers 706 provide a spring force to the opposite side of pressure washer 708 so that friction facing 710 may impart rotation to drive coupling 712. Washer 714 and lock screw 716 are disposed within drive coupling 712 and function to lock the drive coupling 712 to hub 700. Resilient member 718 has a plurality of fingers 719 that fit within gaps 713 of drive coupling 712. Resilient member 718 functions to allow some axial and lateral displacement between the drive and driven end of the clutch 340. Clutch pawl 720 has protuberances 722 that fit within gaps 723 of resilient member 718 so that the rotation of drive coupling 712 via the friction facing 710 can rotate clutch pawl 720 and, in turn, rotate drive shaft 618.

As described above, rotating shaft 300 (FIG. 6) may change rotational speed abruptly or even completely stop in some instances. Forces from this abrupt change in rotational speed could damage drive shaft 618 (FIG. 6) of generator 204. To reduce the risk of damage to drive shaft 618, overrunning clutch 340 provides the interface of friction facing 710 to the facing of drive coupling 712 to ensure that drive shaft 618 changes rotational speed much slower than rotating shaft 300. Any hard mechanical coupling of output shaft 612 with drive shaft 618 would damage the components of drive shaft 618. In one embodiment, if forces from this abrupt change in rotational speed are above a set torque (for example, nine Newton-meters) this could damage generator 204. Allowing a portion of overrunning clutch 340 to release from another portion of overrunning clutch 340 prevents this torque from damaging drive shaft 618 of generator 204 or hydraulic pump 323.

FIG. 8 is a cross-sectional view of saver sub 308 in accordance with one embodiment of the present invention. As described above, saver sub 308 has external threads 317 that facilitate the coupling of saver sub 308 to box end 306 of rotary steerable directional drilling tool 36. According to one embodiment, internal threads 316 and external threads 317 are non-tapered, having a substantially constant diameter, although other types of threads may be used. Saver sub 308 also includes internal threads 800 that function to couple drill bit 40 or other drilling tool (not shown) to the bottom of drill string 30. In one embodiment threads 800 are conventional drilling tool threads, i.e. four and one-half inch internal flush according to a standard published by the American Petroleum Institute ("API-IF"); however, other oilfield thread sites and types may be used. Because of extreme wear encountered during the drilling of well bore 32, saver sub 308 is used to couple drill bit 40 to box end 306 to avoid having to replace box end 306 periodically; replacing saver sub 308 periodically is not as expensive as replacing box end 306.

One consideration when installing saver sub 308 onto box end 306 is the centering of saver sub 308. A properly centered saver sub reduces unwanted dynamic loads (e.g., vibration and chatter), as well as wear of external threads 317, during the drilling operation. According to the teachings of one embodiment of the present invention, saver sub 308 is a self-centering saver sub. The self-centering is facilitated by a curved and tapering thread shoulder 804 around the perimeter of saver sub 308. Thread shoulder 804 is defined by the region of saver sub 308 between an inside perimeter 810 and an outside perimeter 812.

The curved portion of thread shoulder 804, which is associated with inside perimeter 810, may have any suitable curvature with any suitable radius; however, preferably a radius of the curved portion of thread shoulder 804 is about one half inch. The tapered portion of thread shoulder 804 (upward taper 806), which tapers towards external threads 317, may be tapered at any suitable angle 807; however, in one embodiment, angle 807 is approximately thirty degrees.

Because thread shoulder 804 has a curved portion and a tapered portion, a low portion 814 is associated with thread shoulder 804. Low portion 814 extends around the perimeter of thread shoulder 804 and the radial distance from any point of low portion 814 to the centerline of saver sub 308 is substantially equal. Low portion 814 will substantially match up with a high portion 816 on a shoulder 805 of box end 306 when saver sub 308 is installed thereon, as described below. High portion 816 extends around the perimeter of box end 306 and the radial distance from any point on high portion 816 to the centerline of box end 306 is substantially equal. The lengths and locations of external threads 317 and internal threads 316 are designed such that when a metal to metal seal is formed between shoulders 805 and 804 the threads are engaged. Because tolerances (via manufacturing or wear) associated with external threads 317 and internal threads 316 may result in some radial movement of saver sub 308 when being installed, saver sub 308 will continue to be threaded onto box end 306 until low portion 814 and high portion 816 engage, thus ensuring that saver sub 308 is centered on box end 306 when installed. In contrast, a saver sub having a flat shoulder around its circumference would be susceptible to off-centering because there is nothing to ensure that the centerlines of the saver sub and the box end match up.

According to one embodiment of the invention, external threads 317 and internal threads 316 are configured to not be easily releasable. In other words, although saver sub 308 may be threaded into box end 306, once threaded, external threads 317 and internal threads 316 provide substantial resistance to decoupling. An epoxy may also be used to further couple together threads 316 and 317. Threads 316 and 317 may comprise, in one example, metric threads that, when coupled, are not easily releasable. Such a configuration avoids inadvertent unthreading of saver sub 308 from the box end, but allows easy attachment of saver sub 308 to box end 306.

Although embodiments of the invention and their advantages are described in detail, a person of ordinary skill in the art could make various alterations, additions, and omissions without departing from the spirit and scope of the present invention as defined by the appended claims.

What is claimed is:

1. A system for generating power for a rotary steerable directional drilling tool, comprising:

a drive shaft adapted to be coupled to a drill string;

a housing coupled externally to the drive shaft and supported so as to be able to rotate relative to the drive shaft;

a reduction gear having an input rotatably coupled to the drive shaft and an output;

an overrunning clutch operatively coupled at one end to the output of the reduction gear; and at least one of an electric generator and an hydraulic pump rotatably coupled to another end of the overrunning clutch.

2. The system as defined in claim 1, further comprising a compliant mount coupling a non-rotating part of the at least one of the generator and pump to the housing.

3. The system as defined in claim 2, wherein the compliant mount comprises an elastomer.

4. The system as defined in claim 1, wherein the drive shaft comprises splines operatively coupled to the reduction gear.

5. The system of claim 1, wherein the overrunning clutch comprises:

a drive hub operatively coupled to the output of the reduction gear;

a friction facing operatively coupled to the drive hub;

a clutch pawl coupled to a second drive shaft; and a drive coupling in frictional engagement with the friction facing to transfer rotation of the reduction gear output to the second drive shaft.

6. The system of claim 5, wherein the friction facing comprises debris slots thereon.

7. A system for power generation inside a steering tool, comprising:

a drive system disposed within a wall of the steering tool, the drive system comprising:

a gear casing;

an output gear coupled to an output shaft rotatably disposed within the gear casing, the output gear having a plurality of output gear teeth;

a drive shaft coupled to the output shaft with an overrunning clutch; and an idler gear rotatably coupled to an idler shaft and having a plurality of idler gear teeth meshing with the output gear teeth;

a rotating shaft rotatably coupled to a non-rotating sleeve of the steering tool;

a spline coupled to the rotating shaft, the spline having a plurality of spline teeth meshing with the idler gear teeth; and whereby a rotation of the rotating shaft rotates the spline, which rotates the idler gear, which rotates the output gear, which rotates the output shaft, which rotates the drive shaft.

8. The system of claim 7, further comprising disposing a compliant mount between an outside surface of the gear casing and the inside surface of the wall of the non-rotating sleeve.

9. The system of claim 8, wherein the compliant mount is formed from an elastomer.

10. The system of claim 7, wherein the drive shaft is operable to drive a generator within the wall of the non-rotating sleeve.

11. The system of claim 7, wherein the drive shaft is operable to drive a hydraulic pump within the wall of the non-rotating sleeve.

12. The system of claim 7, wherein the overrunning clutch comprises:

a driving hub coupled to the output shaft;

a pressure washer having a friction facing coupled to the driving hub;

a clutch pawl coupled to the drive shaft; and a drive coupling coupled to the clutch pawl, a face of the drive coupling in frictional engagement with the friction facing of the pressure washer to transfer rotation of the output shaft to the drive shaft.

13. The system of claim 7, wherein the spline is integral to the rotating shaft.

14. The system of claim 7, wherein the output shaft is rotatably disposed within the gear casing by a pair of ball bearings.

15. A system for power generation inside a steering tool, comprising:

a drive system disposed within a wall of the steering tool, the drive system comprising:

a drive shaft;

a gear casing;

an output gear coupled to an output shaft rotatably disposed within the gear casing, the output gear having a plurality of output gear teeth;

an overrunning clutch coupling the drive shaft to the output shaft; and an idler shaft coupled to an idler gear, the idler gear having a plurality of idler gear teeth meshing with the output gear teeth on one side of the idler shaft and meshing with a plurality of spline teeth of a spline on the other side of the idler shaft;

a rotating shaft rotatably coupled to a non-rotating sleeve of the steering tool; and the spline coupled to the rotating shaft, the spline operable to indirectly drive the drive shaft by directly coupling to the idler gear of the drive system.

16. The system of claim 15, further comprising a compliant mount disposed between an outside surface of the gear casing and an inside surface of the wall of the non-rotating sleeve.

17. The system of claim 16, wherein the compliant mount is formed from an elastomer.

18. The system of claim 15, wherein the overrunning clutch comprises:

a driving hub coupled to the output shaft;

a pressure washer having a friction facing coupled to the driving hub;

a clutch pawl coupled to the drive shaft; and a drive coupling coupled to the clutch pawl, a face of the drive coupling in frictional engagement with the friction facing of the pressure washer to transfer rotation of the output shaft to the drive shaft.

19. The system of claim 15, wherein the drive shaft is operable to drive a generator within a wall of the non-rotating sleeve.

20. The system of claim 15, wherein the drive shaft is operable to drive a hydraulic pump within a wall of the non-rotating sleeve.

21. The system of claim 15, wherein the spline is integral to the rotating shaft.

22. A method for generating power inside a steering tool, comprising:

coupling a spline to a rotating shaft, the spline having a plurality of spline teeth;

rotating the shaft within a non-rotating sleeve of the steering tool;

driving a drive shaft of a drive system by meshing the spline teeth with a plurality of teeth of an idler gear of the drive system;

disposing at least a portion of the drive system within a gear casing; and disposing a compliant mount between an outside surface of the gear casing and an inside surface of the wall of the non-rotating sleeve.

23. The method of claim 22, wherein the compliant mount is formed from an elastomer.

24. The method of claim 22, further comprising coupling the drive shaft to an output shaft of the drive system with an overrunning clutch.

25. The method of claim 22, further comprising disposing the drive system within a wall of the steering tool.

* * * * *